United States Patent [19]

Tietjens

[11] 4,192,065

[45] Mar. 11, 1980

[54] SHAVING APPARATUS

[75] Inventor: Eduard W. Tietjens, Drachten, Netherlands

[73] Assignee: U.S. Philips Corporation, New York, N.Y.

[21] Appl. No.: 963,536

[22] Filed: Nov. 24, 1978

Related U.S. Application Data

[63] Continuation of Ser. No. 794,565, May 6, 1977, abandoned.

[30] Foreign Application Priority Data

May 14, 1976 [NL] Netherlands ..... 7605150

[51] Int. Cl.[2] ..... B26B 19/14

[52] U.S. Cl. ..... 30/43.6; 30/346.51

[58] Field of Search ..... 30/43.4, 43.5, 43.6, 30/43.92, 346.51

[56] References Cited

U.S. PATENT DOCUMENTS

| | | | |
|---|---|---|---|
| 2,283,865 | 5/1942 | Cohen | 30/43.6 X |
| 2,472,853 | 6/1949 | Lorenz | 30/43.6 |
| 2,982,021 | 5/1961 | Miller | 30/43.6 |
| 3,088,205 | 5/1963 | Ellis | 30/43.6 X |
| 3,890,709 | 6/1975 | Tietjens | 30/43.6 |

FOREIGN PATENT DOCUMENTS

| | | | |
|---|---|---|---|
| 2364646 | 7/1974 | Fed. Rep. of Germany | 30/43.6 |

*Primary Examiner*—Gary L. Smith

*Attorney, Agent, or Firm*—Thomas A. Briody; William J. Streeter; Rolf E. Schneider

[57] ABSTRACT

A shaving apparatus comprising a cutting member driven relative to a shear plate, spring means to press the cutting member against the shear plate, a pair of outwardly bent opposed tabs provided on the cutting member, and a disc member spaced from the cutting member and provided with means for location between and cooperation with the opposed tabs in order to couple the cutting member and the disc member.

6 Claims, 5 Drawing Figures

SHAVING APPARATUS

Figure 1:
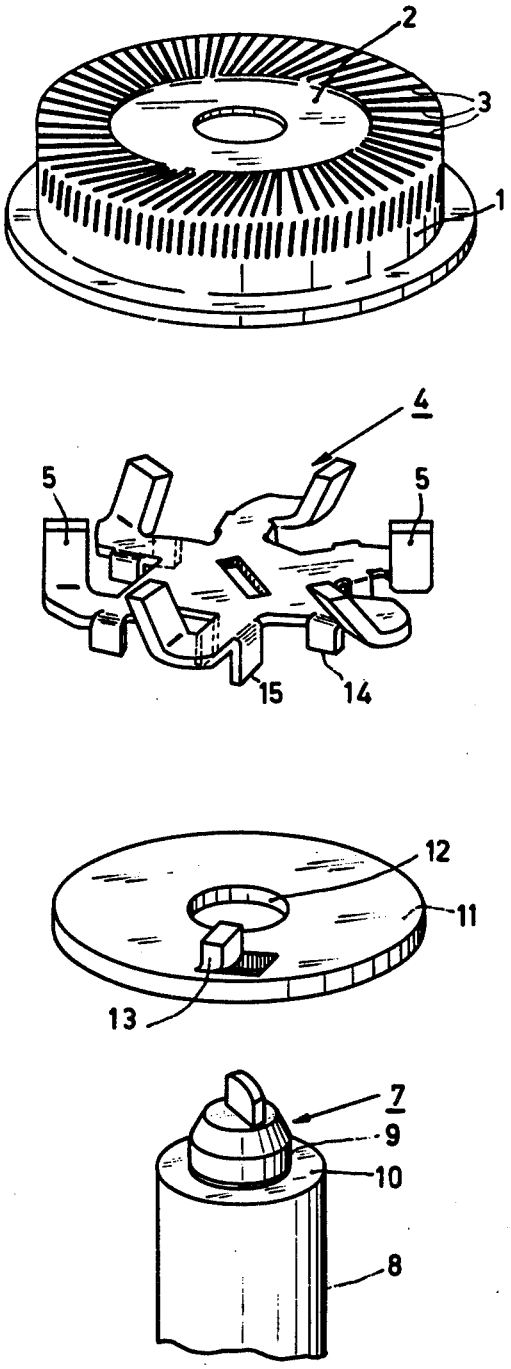

This is a continuation of application Ser. No. 794,565, filed May 6, 1977, now abandoned.

This invention relates to a shaving apparatus having a shear plate in which openings are formed and a cutting member which is driven relative to the shear plate, which member is pressed against the shear plate by means of spring force.

In such known shaving apparatus the cutting member owing to a hair which projects through an opening of the shear plate will be urged away from the shear plate during the cutting operation. It is then not unlikely that a hair which projects through a subsequent opening of the shear plate is not cut correctly or not at all, because the cutting member has not yet returned to a correct cutting position in engagement with the shear plate. By increasing the spring force a cutting member which has been urged away can be made to return to the shear plate more rapidly, but this has the drawback that the friction and thus the wear and the development of heat increase and more power is needed for driving the cutting member.

It is an object of the invention to solve the afore-mentioned problem whilst avoiding the said drawbacks, and the invention is characterized in that an auxiliary mass, which can also be driven, is coupled to the cutting member, the auxiliary mass and the cutting member being movable relative to each other.

Owing to the inertia of the auxiliary mass the speed of the cutting member is reduced only slightly, so that a hair is readily cut. The cutting member is then hardly pushed away from the shear plate. After a hair has been cut the cutting member is rapidly accelerated in the direction of rotation and moreover is immediately returned to the shear plate by means of the spring force, because the cutting member is movable relative to the auxiliary mass and also because the cutting member may now be of a light construction. The construction in accordance with this system does not respond to an incidental increase of the driving torque owing to for example soiling. The auxiliary mass only responds to fast and abrupt torque variations, such as in fact occur during cutting only.

Preferably the cutting member and the auxiliary mass are movable relative to each other in a direction transverse to the direction of driving.

One embodiment is characterized in that the cutting member and the auxiliary mass are coupled with the aid of coupling members which include a resilient element, so that the auxiliary mass and the cutting member are resiliently coupled in the direction of driving. The resilient element should preferably be dimensioned so that at the instant that the cutting member is about to cut a hair, the auxiliary mass engages with the cutting member owing to the resilient element. Preferably the resilient element should not exert any force on the cutting member in the direction of the shear plate.

A preferred embodiment is characterized in that the coupling member of at least one of the parts to be coupled comprises an oblique contact face, which is such that upon contact of the parts to be coupled a force is exerted on the cutting member in the direction of the shear plate.

The pressure with which the cutting member is pressed against the shear plate is in fact needed only at the instant that a hair is cut. Owing to the afore-mentioned characteristic feature, the cutting member is only pressed against the shear plate during cutting because of the inertia of the auxiliary mass and the oblique contact face. Thus, an even better shaving result is obtained, whilst moreover the spring force with which the cutting member is pressed against the shear plate can be minimized.

Preferably, the auxiliary mass is a disc, the coupling members of the disc being constituted by tabs which are bent out of the plane of the disc.

Another embodiment is characterized in that the auxiliary mass is spherical and is located in a space between the coupling members of the cutting member and a supporting plate. In this embodiment the friction between the auxiliary mass and the cutting member, and between the auxiliary mass and the supporting plate is minimal.

Preferably three spherical auxiliary masses are provided which are interconnected to form a single component.

In all the afore-mentioned embodiments it is advantageous to form the coupling members of the cutting member by bending tabs out of the cutting member.

Figure 2:
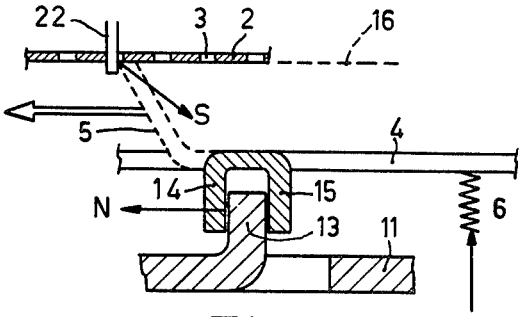
Figure 3:
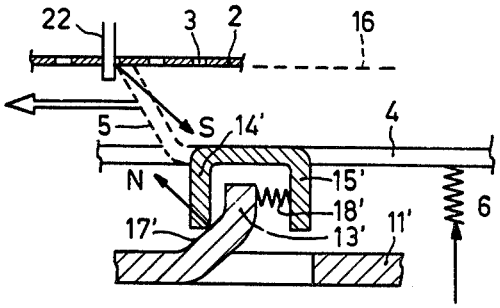
Figure 4:
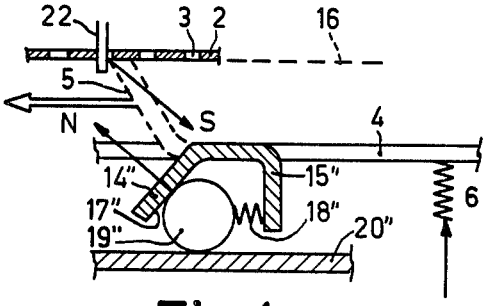
Figure 5:
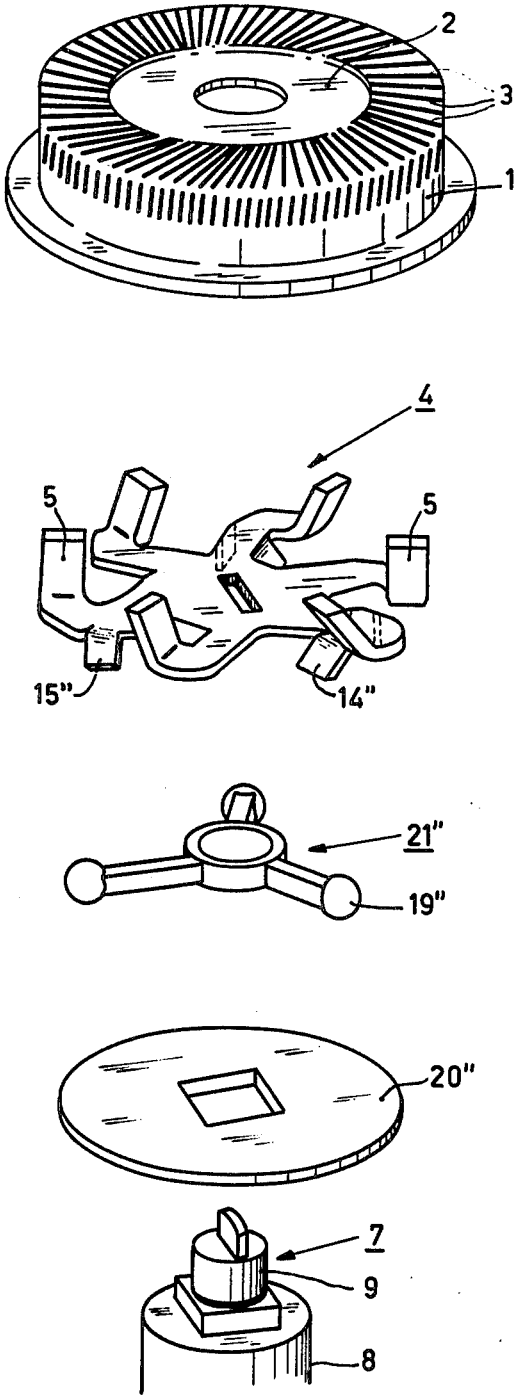

The invention will be described in more detail with reference to the embodiments shown in the accompanying drawings, in which:

FIG. 1 shows the components of a shaving head of a rotary shaving apparatus in disassembled condition, FIGS. 2–4 are detailed drawings of a cutting element with the auxiliary mass shown in various embodiments, and FIG. 5 shows the construction in accordance with FIG. 4 in disassembled condition.

The cutting member 4, which is provided with raised cutting elements 5, is rotatable in the cutter guard 1, which is provided with a shear plate 2 with hair-entrance openings 3. The cutting member 4 is driven by a drive pin 7. This drive pin is driven by the drive spindle 8 and is resiliently depressable in the drive spindle 8 (not shown). The resilient drive pin 7 presses the cutting elements 5 of the cutting member 4 against the shear plate 2. In FIGS. 2–4 this is schematically represented by a spring 6. The spring force is only small. An auxiliary mass in the form of a disc 11, is coupled to the coupling members 14 and 15 of the cutting member 4 with the aid of coupling member 13 (see FIG. 2). The coupling members 14 and 15 are constituted by two tabs which are bent out of the cutting member, between which tabs is located the coupling member 13 which is obtained by bending a tab out of the plane of the disc 11. The cutting member 4 is movable relative to the disc 11 in a direction perpendicular to the cutting face 16, whilst the coupling member 13 remains constantly between the coupling members 14 and 15. The disc 11 has an opening 12, whose diameter is greater than that of the portion 9 of the drive pin 7, so that the disc 11 can rotate over the rim 10 of the drive spindle.

In FIG. 3 the coupling member 13' has an oblique contact face 17'. Moreover, a spring 18' is fitted between the coupling member 15' of the cutting member 4 and the coupling member 13' of the disc 11', so that the coupling members 13' and 14' are constantly pressed towards each other. Instead of providing the coupling member 13' with an oblique contact face, the coupling member 14' may alternatively be provided with an oblique contact face.

In FIG. 4 the mass is formed by a sphere 19'' which is enclosed between the coupling member 14'' and 15'' and the supporting plate 20'', the coupling member 14'' having an oblique contact face 17''. The sphere 19'' is constantly pressed towards the oblique contact face 17'' by the spring 18''. The supporting plate 20'' is driven by the drive spindle 8. It is not necessary to provide a sphere 19'' for each cutting element 5. For example, in the case of a cutting member with six cutting elements only three spheres with associated coupling members may be utilized. The movement of the spheres should of course be limited in a radial direction. In FIG. 5 this is achieved by interconnecting three spheres 19'' to form one component 21'', which moreover eliminates the occurrence of unbalanced forces. The component 21'' can freely rotate over the part 9 of the drive pin 7.

The effect of the mass is as follows: At the instant that a hair 22 which projects through an opening 3 of the shear plate 2 is about to be cut off, the speed of the cutting element 5 is reduced by the occurrence of the cutting force S. The direction of the cutting force S is such that the cutting element 5 is pressed downwards, i.e. away from the shear plate 2. However, owing to the mass inertia of the disc 11 the coupling member 13 presses against the coupling member 14 of the cutting member with a force N, so that the hair 22 is readily and rapidly cut. As a result, the cutting element 5 is only slightly pressed away from the shear plate 2. The spring 6 ensures that the cutting element 5 correctly engages with the shear plate 2. By providing the coupling member 13' (see FIG. 3) with an oblique contact face 17', it is possible to assure that during cutting the cutting element 5 is urged towards the shear plate 2 by the mass inertia of the disc 11', and thus remains in engagement with the shear plate 2. The force N on the coupling member 14' has a component which is directed towards the shear plate 2. Owing to this component the force of the spring 6 may now be chosen very small. After the cutting operation the cutting member 4, which may be of a light construction, is accelerated again and the disc 11 then slightly lags behind said member. In order to ensure that for the next hair to be cut the coupling member 13' in any case is in contact with the coupling member 14', the spring 18' is fitted between coupling member 13' and coupling member 15'.

The construction of FIG. 4 operates in an identical manner as the construction hereinbefore.

What is claimed is:

1. A shaving apparatus which comprises a shear plate formed with openings, a cutting member having a flat portion, spring means to press the cutting member against the shear plate, means including a drive shaft for driving the cutting member for rotation relative to the shear plate, said cutting member fitting over the drive shaft and engaging the same, a pair of opposed tabs bent outwardly from the flat portion of the cutting member, a disc member disposed opposite to and spaced from the flat portion of the cutting member, said disc member being freely rotatively positioned on said drive shaft, and means associated with the disc member for location between and cooperation with the pair of opposed tabs in order to couple the cutting member and the disc member, the cutting member and the disc member being thereby movable relative to each other in the direction of driving the cutting member and also being thereby movable relative to each other in a direction transverse to the direction of driving the cutting member.

2. A shaving apparatus according to claim 1, which includes a resilient member positioned between one tab of the cutting member and the means located between the pair of opposed tabs so that the cutting member and the disc member are resiliently coupled in the direction of driving the cutting member.

3. A shaving apparatus according to claim 2, in which the other tab of the cutting member is obliquely bent so that, upon contact of said means with said obliquely bent tab, a force is exerted on the cutting member in the direction of the shear plate.

4. A shaving apparatus according to claim 1, in which the means associated with the disc member comprises a tab obliquely bent outwardly from such disc member, and which includes a resilient member between one tab of the cutting member and said obliquely bent tab so that, upon contact of the obliquely bent tab with the other cutting member tab, a force is exerted on the cutting member in the direction of the shear plate.

5. A shaving apparatus according to claim 1, in which the means associated with the disc member comprises a sphere.

6. A shaving apparatus according to claim 5, in which three spheres are associated with the disc member, said spheres being interconnected to form a single component.

* * * * *